US006955465B2

(12) United States Patent
Machacek et al.

(10) Patent No.: US 6,955,465 B2
(45) Date of Patent: Oct. 18, 2005

(54) POWDER-RESISTANT FLEXIBLE ZIPPER FOR RECLOSABLE PACKAGING

(75) Inventors: Zdenek Machacek, Nanuet, NY (US); Michael Lasofsky, Pomona, NY (US); Glyn Russell, New City, NY (US)

(73) Assignee: Illinois Tool Works Inc., Glenview, IL (US)

( * ) Notice: Subject to any disclaimer, the term of this patent is extended or adjusted under 35 U.S.C. 154(b) by 79 days.

(21) Appl. No.: 10/123,616

(22) Filed: Apr. 15, 2002

(65) Prior Publication Data

US 2003/0194154 A1 Oct. 16, 2003

(51) Int. Cl.[7] ..... B65D 33/16

(52) U.S. Cl. ..... 383/63; 24/324; 24/585.12; 24/DIG. 50

(58) Field of Search ..... 383/100, 103, 383/61.2, 61.1, 63; 24/DIG. 50, 585.12, 24/584.1

(56) References Cited

U.S. PATENT DOCUMENTS

| | | | | |
|---|---|---|---|---|
| 4,532,652 A | | 7/1985 | Herrington | |
| 4,817,188 A | | 3/1989 | Van Erden | |
| 4,841,603 A | * | 6/1989 | Ragni | 24/584.1 |
| 4,964,739 A | | 10/1990 | Branson et al. | |
| 5,017,021 A | | 5/1991 | Simonsen et al. | |
| 5,067,210 A | * | 11/1991 | Keyaki | 24/452 |
| 5,070,584 A | | 12/1991 | Dais et al. | |
| 5,273,511 A | | 12/1993 | Boeckman | |
| RE34,554 E | | 3/1994 | Ausnit | |
| 5,363,540 A | | 11/1994 | Dais et al. | |
| 5,403,094 A | | 4/1995 | Tomic | |
| 5,509,734 A | * | 4/1996 | Ausnit | 383/63 |
| 5,617,770 A | | 4/1997 | May | |
| 5,829,884 A | | 11/1998 | Yeager | |
| 5,878,468 A | | 3/1999 | Tomic et al. | |
| 5,901,625 A | | 5/1999 | May | |
| 5,934,806 A | | 8/1999 | Tomic et al. | |
| 6,047,450 A | | 4/2000 | Machacek et al. | |
| 6,152,600 A | | 11/2000 | Tomic | |
| 6,231,236 B1 | * | 5/2001 | Tilman | 383/61.2 |
| 6,299,353 B1 | | 10/2001 | Piechocki et al. | |
| 6,463,634 B1 | * | 10/2002 | Naohara et al. | 24/444 |
| 2003/0066267 A1 | * | 4/2003 | Nelson | 53/412 |

FOREIGN PATENT DOCUMENTS

| | | | |
|---|---|---|---|
| EP | 0 398 732 B1 | | 8/1994 |
| JP | 2-139352 | * | 5/1990 |
| JP | 11-137311 | * | 5/1999 |

* cited by examiner

*Primary Examiner*—Joseph C. Merek
(74) *Attorney, Agent, or Firm*—Ostrager Chong Flaherty & Broitman P.C.

(57) ABSTRACT

A flexible zipper intended for use in a package containing powder or other particulate matter. The zipper is designed to be resistant to clogging of the interlocking profiles with powder. This flexible zipper has first and second profiles that interlock in a closed zipper state to define a space therebetween. The space extends in a longitudinal direction, i.e., along the length of the zipper. The bases of both profiles are provided with apertures for enabling powder or other particulate matter trapped in the space between the profiles to pass into the interior volume of a package.

20 Claims, 4 Drawing Sheets

POWDER-RESISTANT FLEXIBLE ZIPPER FOR RECLOSABLE PACKAGING

BACKGROUND OF THE INVENTION

This invention pertains to a zipper for a reclosable package, such as a bag manufactured by a form, fill and seal apparatus, wherein the base of at least one of the zipper strips has apertures that allow packaged product, such as powder, to pass through the apertures and return to the interior volume of the reclosable package.

In the prior art, it is known to use a zipper with a female profile and a male profile in the manufacture of a reclosable package, such as a bag manufactured by a form, fill and seal apparatus. However, it is further known that if the reclosable package is filled with a fine powder product, then the fine powder or particulate matter can enter the female profile and degrade the performance of the zipper by blocking insertion of the male profile. Furthermore, if the user cleans this fine powder product from the female profile, this powder tends to be discarded rather than returned to the reclosable package. Moreover, such cleaning of the female profile can tend to contaminate any fine powder product that is returned to the reclosable package.

U.S. Pat. No. 6,299,353, entitled "Zipper for Reclosable Container with Apertures Passing Through Female Profile" and assigned to the assignee of the instant application, discloses a zipper with a female profile wherein spaced apertures are formed in the base thereof. The apertures communicate with the powder-containing interior volume of a reclosable package. When fine powder product becomes lodged within the female profile, an arrow-shaped male element of the male profile can push the lodged fine powder product through the apertures in the base of the female profile, to return the powder to the interior volume of the reclosable package. Since the legs of the female profile, as well as the male element of the male profile, remain intact, there is no degradation of the sealing provided by the zipper. Moreover, the direction of travel of the fine powder product through the apertures is substantially the same as the travel direction of the male element as it enters the female profile. As the fine powder product can be returned to the interior volume of the reclosable package without directly contacting the consumer, the fine powder product tends to be returned to the interior volume of the reclosable package free of contamination. To prevent powder from entering the female profile through the apertures, the female profile material that is cut to form the apertures may be left attached along an edge, thereby forming a flap that can serve as a simple one-way valve to permit powder to be removed from the female profile via the apertures, while preventing powder from entering the female profile via the apertures.

Flexible plastic zippers in which the male profile does not have an arrow shape are well known. For example, in one type of flexible zipper, the female profile comprises a pair of spaced legs or hooks having inwardly pointing detents, while the male profile comprises a pair of spaced legs or hooks having outwardly pointing detents, When the male profile penetrates the female profile, both legs of the male profile are located in the space between the legs of the female profile, with the detents of the male and female profiles being latched or interlocked to hold the zipper closed. For zippers of this type that are incorporated in packaging containing powder or other particulate matter, the male profile as well as the female profile can become clogged with powder or particles. Therefore, it would be highly desirable to redesign such zippers to be powder-resistant, i.e., the zipper should be designed to prevent the male profile, as well as the female profile, from becoming clogged with powder or other particulate matter.

BRIEF DESCRIPTION OF THE INVENTION

The present invention is directed to a flexible zipper intended for use in a package containing powder or other particulate matter. The zipper is designed to be resistant to clogging of the interlocking profiles with powder. The invention is also directed to packages incorporating such powder-resistant zippers.

The flexible zippers disclosed herein comprise first and second profiles that interlock in a closed zipper state to define a space therebetween. The space extends in a longitudinal direction, i.e., along the length of the zipper. In some embodiments, the bases of both profiles are provided with apertures for enabling powder or other particulate matter trapped in the space between the profiles to pass into the interior volume of a package. In other embodiments, one or more posts are incorporated in one profile for pushing powder out of apertures formed in the same profile or in the other profile.

In accordance with some embodiments of the invention, the first and second profiles are male and female profiles respectively. The male profile comprises a plurality of apertures in direct communication with the longitudinal space formed between the male and female profiles. Preferably, these apertures are arranged at spaced intervals along a longitudinal axis of the male profile. The male profile comprises a base and first and second profiled members connected to the base. In accordance with the disclosed embodiments, the first and second profiled members have hook-shaped profiles with outwardly pointing detents and are spaced apart in mutually parallel relationship. The plurality of apertures is located between respective connections of the base to first and second profiled members.

Similarly, the female profile comprises a base, a plurality of apertures in direct communication with the longitudinal space, and third and fourth profiled members connected to its base. However, the third and fourth profiled members have hook-shaped profiles with inwardly pointing detents that latch behind the outwardly pointing detents of the male profile to lock the male profile in the closed position. The third and fourth profiled members of the female profile are spaced apart in mutually parallel relationship. The apertures formed in the female profile are located between respective connections of its base to the third and fourth profiled members.

Another aspect of the invention is a flexible zipper comprising male and female profiles that interlock in a closed zipper state to define a space therebetween that extends in a longitudinal direction. The male profile comprises a first base comprising a plurality of apertures in direct communication with the space, and first and second profiled members connected to and projecting generally transverse relative to the first base on opposite sides of the apertures. The female profile comprises a second base and third through fifth profiled members connected to and projecting generally transverse relative to the second base. The fourth profiled member is between the third and fifth profiled members and projects between the first and second profiled members when the male and female profiles are interlocked.

Yet another aspect of the invention is a flexible zipper comprising male and female profiles that interlock in a closed zipper state to define a space therebetween that extends in a longitudinal direction. The male profile comprises a first base and first and second profiled members connected to and projecting generally transverse relative to the first base, part of the space lying between the first and second profiled members. The female profile comprises a second base comprising a plurality of apertures in direct communication with the space, third and fourth profiled members connected to and projecting generally transverse relative to the second base on opposite sides of the apertures, and a plurality of spaced posts arranged in alternating sequence with the apertures and projecting between the first and second profiled members when the male and female profiles are interlocked.

In accordance with further alternative embodiments, during formation of the apertures in the male and female profiles, the material is cut in a manner that leaves flaps of material attached along one or more edges of each aperture. Also, the outer surface of the base of each profile can be provided with knobs adjacent to or near each aperture that project outward.

In accordance with further embodiments of the invention, a flexible zipper having apertured male and female profiles is incorporated in a package that, when filled, will contain powder or other particulate matter. Each apertured zipper profile comprises a base having an extension flange that extends away from the interior volume of the receptacle. In other words, the extension flanges lie on the side of the interlocked zipper elements that is opposite to the side where the interior volume of the package is located. The edge sections of the front and rear body panels (comprising sheets of film) of the package are heat-fused, bonded or otherwise attached to the respective extension flanges. The result is that the space formed by the interlocked male and female profiles is in communication with the interior volume of the package via the apertures. Preferably, knobs are provided on the outer surfaces of the bases of the zipper profiles to maintain the communication paths from the longitudinal space formed by the male and female profiles to the interior volume of the package. As a result, powder or other particulate matter trapped in the longitudinal space between the interlocked male and female profiles can pass through the apertures and thereby be returned, without be contaminated, to the mass of powder or other particular matter contained in the interior volume of the package.

The invention is not limited to zippers having a male profile with outwardly pointing detents and a female profile with inwardly pointing detents. Instead, one profile may comprise first and second mutually parallel locking members (e.g., having hook-shaped profiles), each of the first and second members having a respective detent pointing in one and the same direction, while the other complementary profile will comprise third and fourth mutually parallel locking members (e.g., having hook-shaped profiles), each of the third and fourth members having a respective detent pointing in the opposite direction. In such embodiments, each profile base could be provided with a row of apertures in the region between its parallel locking members, which apertures would provide a path for powder or other particulate matter trapped between the profiles to be returned to the interior volume of the package.

Other aspects of the invention are disclosed and claimed below.

DETAILED DESCRIPTION OF THE INVENTION

Figure 1:
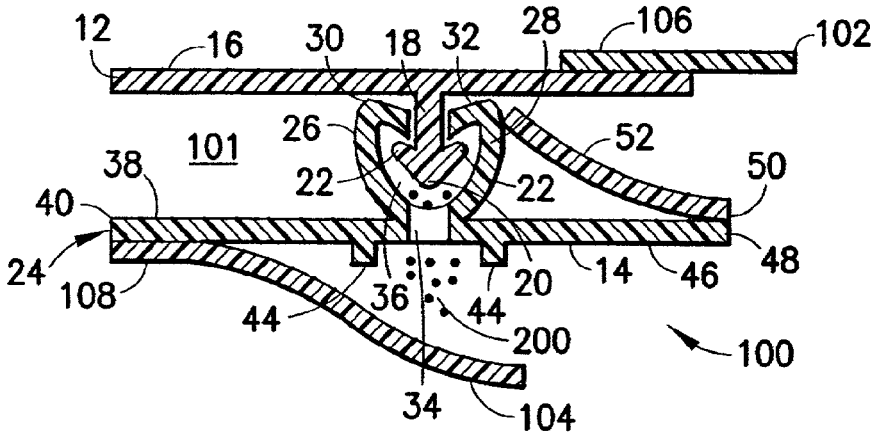
FIG. 1 PRIOR ART
FIG. 1 is a schematic showing a cross-sectional view of the male and female profiles of a prior art zipper, showing powder product passing through apertures in the female profile to the interior of the reclosable package. The male profile has an arrow shape.

Reference will now be made to the drawings, in which similar elements in different drawings bear the same reference numerals. The structure of a prior art reclosable bag having a powder-resistant flexible plastic zipper will be generally described with reference to FIG. 1. Then the structure of a powder-resistant zipper in accordance with a first embodiment will be described with reference to FIGS. 2 and 3; and the structure of a powder-resistant zipper in accordance with a second embodiment will be described with reference to FIGS. 4–6. It should be understood that the powder-resistant zippers shown in FIGS. 2 and 4 can be installed in a reclosable bag in the manner shown in FIG. 3 by any conventional means, such as heat fusion, adhesive, and bonding strips.

FIG. 1 is a cross-sectional view of a prior art zipper attached to a package or bag 100 (only partly depicted). Bag 100 is typically formed from an upper film sheet 102 and a lower film sheet 104 (the terms "upper" and "lower" are used with respect to the orientation shown in FIG. 1). Upper film sheet 102 and lower film sheet 104 are typically sealed together or folded at three sides, so as to form a mouth 101 of the bag 100 at a fourth side. Typically, a form, fill and seal apparatus (not shown) is used to manufacture bag 100. The zipper is attached to the mouth 101 and can be manipulated to open and close the bag 100. This prior art zipper comprises an extruded zipper half 12 having a male profile and an extruded zipper half 14 having a female profile. For the sake of brevity, these zipper halves will hereinafter be referred to as the "male profile" and the "female profile". Male profile 12 comprises a planar base 16 and a male element having a shaft 18 extending perpendicularly from the planar base 16. Shaft 18 terminates with an enlarged head 20 having outwardly pointing detents 22 for engaging the female profile 14. As shown in FIG. 1, a portion of planar base 16 is welded, i.e., heat-fused, to an edge section 106 of the upper film sheet 102. Alternatively, the entire planar base 16 could be welded to the upper film sheet 102.

Still referring to FIG. 1, the female profile 14 comprises a planar base 24 and first and second legs 26, 28 extending therefrom. Legs 26, 28 terminate in inwardly pointing detents 30, 32, for releasably engaging respective detents 22 of enlarged head 20 of the male profile 12. A plurality of apertures 34 (only one of which is seen in FIG. 1), arranged at spaced intervals along a line that would lie perpendicular to the plane of the drawing sheet in FIG. 1, are formed in the planar base 24, thereby providing communication from the space 36 formed between legs 26, 28 to an opposite side of the planar base 24. The apertures 34 can have any one of a variety of shapes. The planar base 24 comprises a first extension flange 38 on one side thereof that extends away from the first and second legs 26, 28 and has a distal end 40 that is welded to an edge 108 of the lower film sheet 104. Because the portion of planar base 24 proximate to apertures 34 is not welded to the lower film sheet 104, this provides communication from space 36 to the interior of bag 100. Therefore, as shown in FIG. 1, when powder product 200 is lodged within space 36 between legs 26, 28 of the female profile 14, the subsequent insertion of male element into space 36 between legs 26, 28 urges powder product 200 through apertures 34 in the planar base 24 and into the interior of the bag 100.

As shown in FIG. 1, the planar base 24 of female profile 14 further comprises a second extension flange 46 that extends inwardly into the bag 100. The distal end 48 of the second extension flange 46 is welded to the proximal end 50 of a deflector sheet 52. Alternately, deflector 52 and extension flange 46 may be made of one piece and folded at the desired location. The distal end of the deflector sheet 52 abuts the second leg 28 of female profile 14, thereby tending to deflect powder product away from the female profile 14 as powder product is being dispensed from the bag 100, thereby decreasing the amount of powder product 200 which lodges in the space 36 between first and second legs 26, 28 of the female profile 14.

In accordance with this prior art zipper, knobs 44 are formed on the planar base 24 and protrude therefrom adjacent to the apertures 34, thereby maintaining a space between the planar base 24 and the lower film sheet 104, and likewise maintaining a communication path between apertures 34 and the interior of the bag 100 in the face of the pressure exerted against the female profile 14 during closure of the zipper.

Whereas FIG. 1 shows a prior art solution to the problem of powder clogging the female profile of a flexible zipper having an arrow-shaped male element, the present invention is directed to solving a similar problem in cases where a zipper also has two profiles, not just a female profile, that are susceptible to becoming clogged with powder or other particulate matter.

Figure 2:
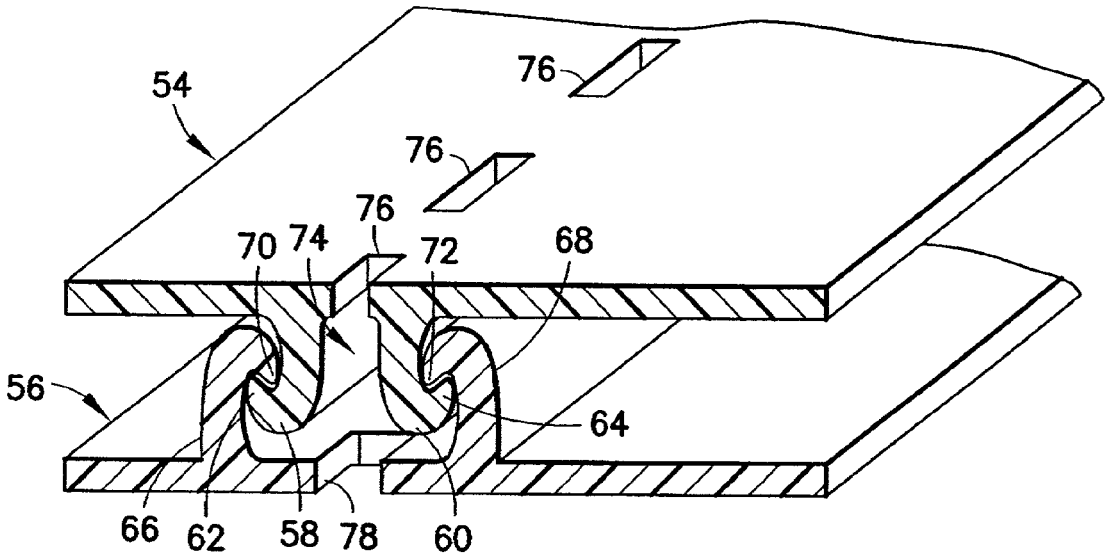
FIG. 2 is a schematic showing an isometric view of the male and female profiles of a powder-resistant flexible zipper in accordance with one embodiment of the invention.

One type of male profile that is susceptible to powder clogging is seen in FIG. 2. The male profile of the zipper is generally designated by the numeral 54, while the female profile of the zipper is generally designated by the numeral 56. In accordance with one embodiment of the invention, the male profile 54 comprises a pair of spaced legs or hooks 58, 60 terminating in respective outwardly pointing detents 62, 64, while female profile 56 comprises a pair of spaced legs or hooks 66, 68 terminating in inwardly pointing detents 70, 72 that respectively releasably engage the detents 62, 64 when the male and female profiles are interlocked, i.e., when the zipper is closed, as seen in FIG. 2. In accordance with this embodiment, the hooks 58 and 60 of the male profile are mutually parallel profiled structures that are separated by a space having a first width, while the hooks 66 and 68 of the female profile are mutually parallel profiled structures that are separated by a space having a second width greater than the first width. The first and second widths are selected so that the crowns of the legs 58, 60 will lie between the crowns of the legs 66, 68 when the male profile first engages the female profile during a closure operation.

Figure 3:
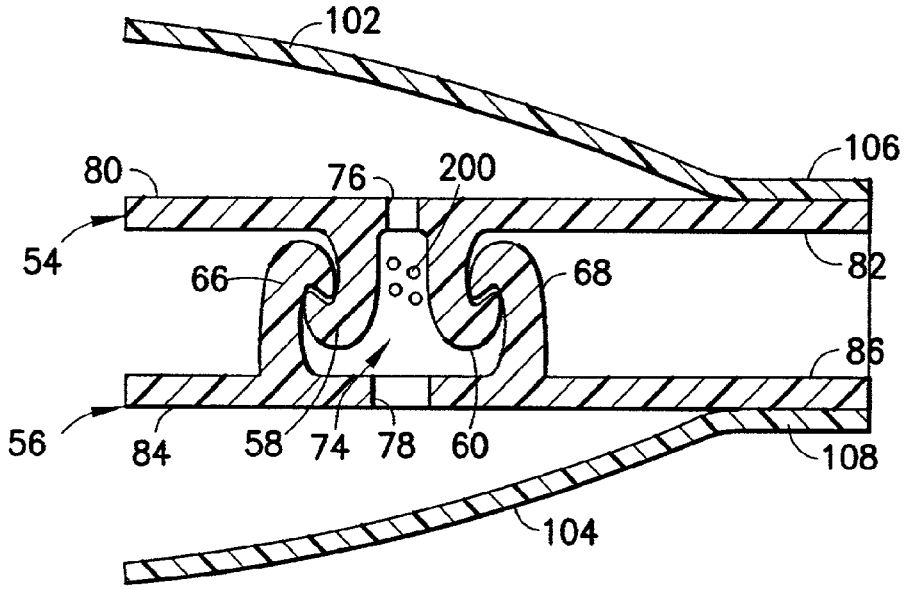
FIG. 3 is a schematic showing a cross-sectional view of the powder-resistant flexible zipper of FIG. 2 incorporated in a reclosable package in accordance with an embodiment of the invention.

As best seen in FIG. 3, when the male and female profiles are interlocked, a hat-shaped space 74 is defined between the interlocked profiles. In accordance with the embodiment depicted in FIGS. 2 and 3, the space 74 communicates with a plurality of apertures 76 (only one shown in FIG. 3) formed in the male profile 54 and with a plurality of apertures 78 (only one shown in FIGS. 2 and 3) formed in the female profile 56. The apertures 76 in the male profile are spaced along a line that runs parallel to and between the legs 58, 60, while the apertures 78 in the female profile are spaced along a line that runs parallel to and between the legs 66, 68. Although the apertures are represented in FIGS. 2 and 3 as rectangles, the apertures may have any other shape, such as circular, oval, elliptical, elongated, square, hexagonal, etc. Further, the apertures in either profile may vary in size. Also the apertures formed in the male profile may differ in shape and/or size from the apertures in the female profile.

Referring to FIG. 3, the male profile 54 comprises a planar base 80 having an extension flange 82 on one side thereof which extends away from the interior volume of the package and has a distal end that is welded to an edge 106 of the upper film sheet 102. Because the portion of planar base 80 proximate to apertures 76 in the male profile is not welded to the upper film sheet 102, this provides communication from space 74 to the interior volume of the bag. Similarly, the female profile 56 comprises a planar base 84 having an extension flange 86 on one side thereof which extends away from the interior volume of the package and has a distal end that is welded to an edge 108 of the lower film sheet 104. Because the portion of planar base 84 proximate to apertures 78 in the female profile is not welded to the lower film sheet 104, this provides a second communication path from space 74 to the interior volume of the bag. As a result of the foregoing construction, when powder product 200 is lodged within space 74, the subsequent insertion of legs 58, 60 of the male profile into the space between legs 66, 68 of the female profile urges powder product 200 through apertures 76 and/or 78 and into the interior volume of the bag. Thus, means are provided for allowing powder to escape from the longitudinal space formed between the interlocked zipper halves into the interior volume of the package or bag. These features resist clogging of either or both of the male and female profiles when the zipper is attached to a package containing powder or other particulate matter.

Figure 4:
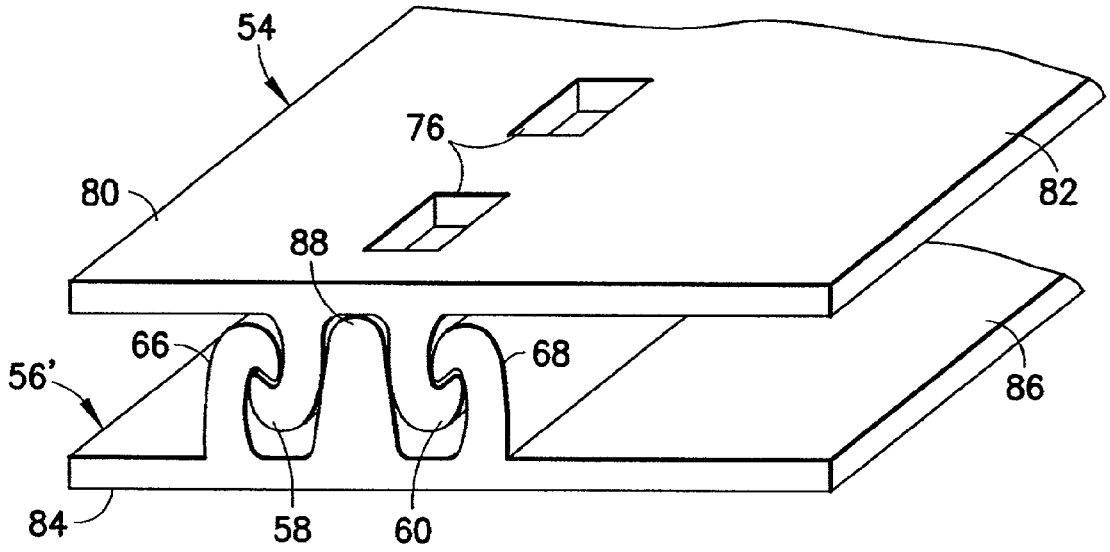
FIG. 4 is a schematic showing an isometric view of the male and female profiles of a powder-resistant flexible zipper in accordance with another embodiment of the invention.

In accordance with a second embodiment of the invention depicted in FIG. 4, the male profile 54 has a series of apertures 76, while the female profile 56' has no apertures. Instead the female profile 56' has a post 88 that fits between the legs 58 and 60 of the male profile 54 and pushes powder out of the apertures 76 in the male profile when the latter is pressed into the female profile 56'. Although not visible in FIG. 4, the post 88 preferably has a length greater than the distance separating the apertures in the male profile that are furthest apart. The distal end of post 88 on the female profile 56' preferably has a rounded or contoured convex profile. The contoured post serves as a guide for proper alignment of the incoming legs of the male profile during a zipper closure operation.

Figure 5:
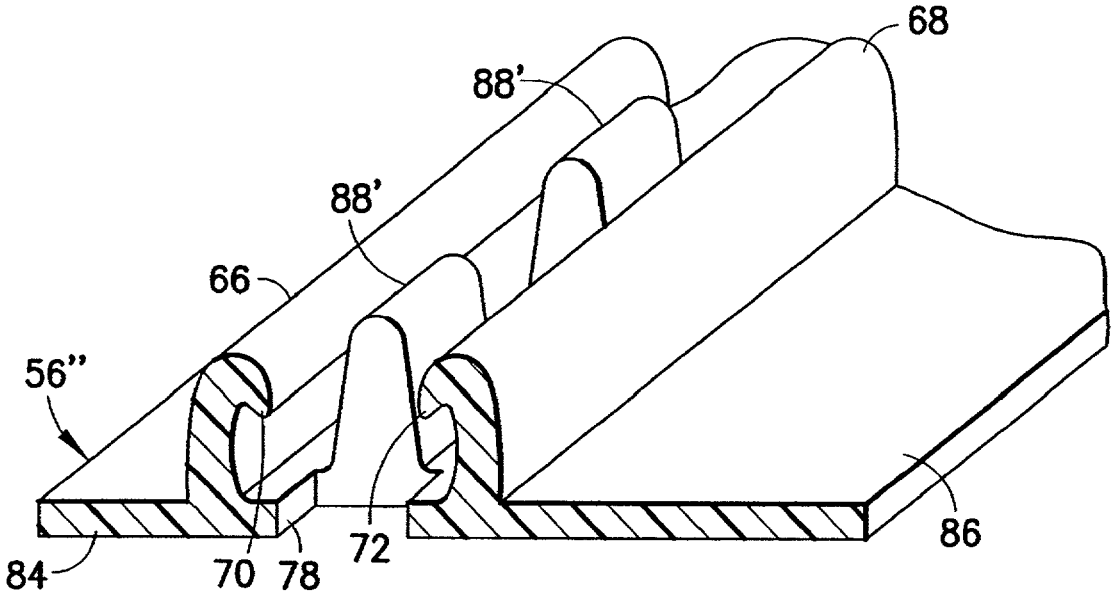
FIGS. 5 and 6 are schematics showing respective isometric views (from opposite sides) of the female profile of a powder-resistant flexible zipper in accordance with a further embodiment.
Figure 6:
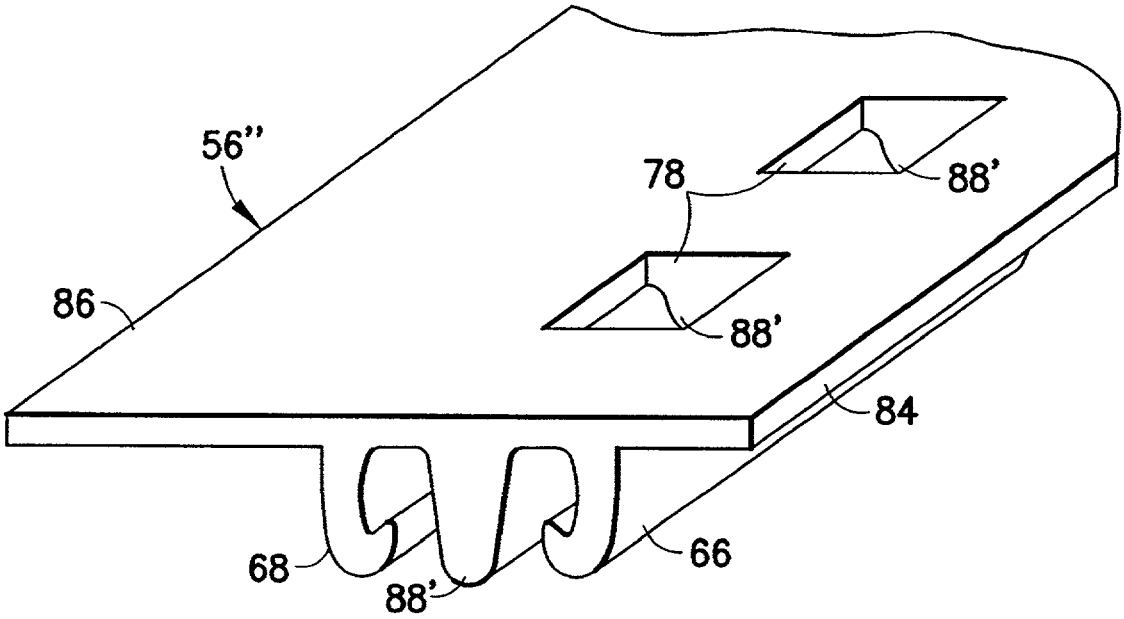

In accordance with another embodiment of the invention depicted in FIGS. 5 and 6, the female profile 56" is provided with a plurality of apertures 78 and a plurality of posts 88' arranged in alternating sequence. The spaced posts 88' are arranged along the same longitudinal line as and alternate with the spaced apertures 78 formed in the female profile. Although not shown in FIGS. 5 and 6, the male profile has the same structure as that shown in FIG. 4, except that the male profile has no apertures 76. As seen in FIGS. 5 and 6, the distal end of each post 88' on the female profile 56" preferably has a rounded or contoured convex profile. The posts 88' also act as guides for the incoming male profile during a zipper closure operation. Powder trapped between the legs 66, 68 of the female profile 56" can be pushed out through the apertures 78 when the male profile is pressed into the female profile. In this case, the apertures are preferably larger in area than the base of an individual post 88'.

Figure 7:
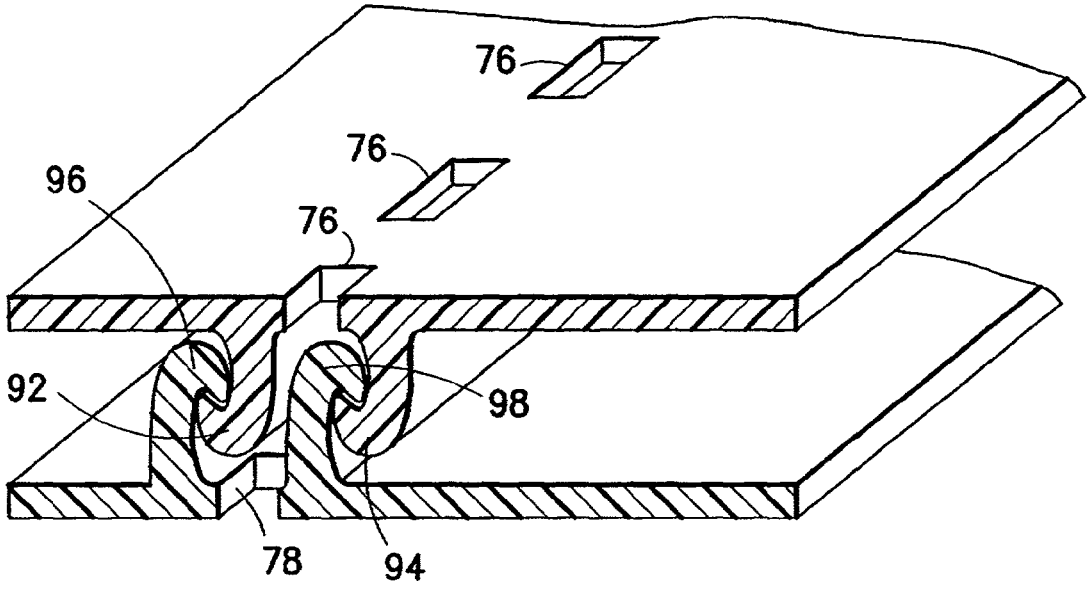
FIG. 7 is a schematic showing an isometric view of the male and female profiles of a powder-resistant flexible zipper in accordance with yet another embodiment of the invention.

A person skilled in the art will appreciate that the invention is not limited to zippers having a male profile with outwardly pointing detents and a female profile with inwardly pointing detents. Instead, one profile may comprise first and second mutually parallel locking members (e.g., having hook-shaped profiles), each of the first and second members having a respective detent pointing in one and the same direction, while the other complementary profile will comprise third and fourth mutually parallel locking members (e.g., having hook-shaped profiles), each of the third and fourth members having a respective detent pointing in the opposite direction. In such embodiments, each profile base could be provided with a row of apertures in the region between its parallel locking members. One example is shown in FIG. 7, wherein one zipper part comprises a series of spaced apertures 76 communicating directly with a space between parallel hooks 92 and 94, while the other zipper part comprises a series of spaced apertures 78 (only one is seen in FIG. 7) communicating directly with a space between parallel hooks 96 and 98, which interlock with hooks 92 and 94.

Figure 8:
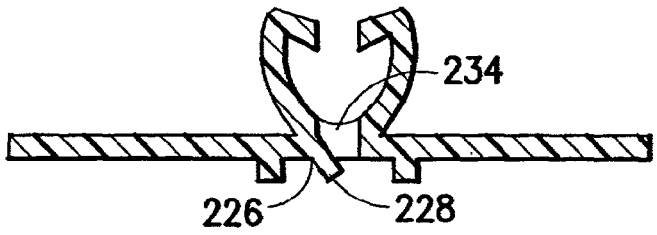
FIG.8 PRIOR ART
FIG. 8 is a schematic showing a cross-sectional view of a prior art female zipper profile provided with a flapped aperture.

FIG. 8 shows an alternative construction for a female profile of the type depicted in FIG. 1. In accordance with this construction, the material cut to provide each spaced aperture 234 formed in the planar base 224 is not removed. Rather, the material is left attached along an edge 226 providing a flap closure 228 for each aperture 234. By cutting or punching the apertures from the top down (i.e., from the arms toward the base), the flaps will position to open below the base 224 of the female profile (as shown in FIG. 8) and thereby serve somewhat as a one-way valve to permit powder to flow out of the female profile into the interior volume of the package, while preventing powder from flowing from the interior volume of the package into the space between the legs of the female profile. In place of a single flap, a pair of flaps may be provided, hinged from opposite sides of the aperture. The person skilled in the art will appreciate that such flaps can also serve as one-way valves for the apertures 76 and 78 seen in FIGS. 2–7.

In addition, the embodiments of the invention depicted in FIGS. 2–7 may also be provided with knobs similar to knobs 44 shown in FIG. 1. For example, such knobs could be formed on the outer surface of the planar base 80 of the male profile 54 (see FIG. 3), a respective set of knobs being placed adjacent or near each aperture 76. These knobs would maintain a space between the planar base 80 of the male profile 54 and the upper film sheet 102 of the bag, and would likewise maintain a communication path between apertures 76 and the interior of the bag in the face of the pressure exerted against the male and female profiles 54 and 56 during closure of the zipper. Knobs would also be formed on the outer surface of the female profile 56 to maintain a communication path between apertures 78 and the interior of the bag.

While the invention has been described with reference to embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "package" means a container, bag, pouch or other receptacle for objects, material or stuff. A container, bag, pouch or other receptacle is deemed to be a package even if not yet packed with objects, material or stuff.

What is claimed is:

1. A flexible zipper comprising first and second zipper parts, said first zipper part comprising a first base, and first and second generally hook-shaped profiled members projecting from one side of said first base, having respective profiles that are substantially constant along the entire length of said first zipper part and disposed generally parallel to each other with a first space therebetween, and said second zipper part comprising a second base, and third and fourth generally hook-shaped profiled members projecting from one side of said second base, having respective profiles that are substantially constant along the entire length of said second zipper part and disposed generally parallel to each other with a second space therebetween, each of said first through fourth profiled members having only one detent projecting from one side of its distal end, said first and second profiled members being respectively interlockable with said third and fourth profiled members to close said zipper, said interlocked profiled members and said first and second bases defining a zipper internal volume, wherein said first base comprises a first plurality of apertures that form communication pathways from said zipper internal volume to a volume on another side of said first base, the entirety of each aperture of said first plurality being disposed between said first and second generally hook-shaped profiled members, and each aperture of said first plurality having a dimension along a line parallel to a lengthwise direction of said first zipper part that is less than the length of said first zipper part.

2. The zipper as recited in claim 1, wherein said detents of each said first and second profiled members point away from each other, while said detents of said third and fourth profiled members point toward each other, said detents of said first and second profiled members being disposed between said third and fourth profiled members when the zipper is closed.

3. The zipper as recited in claim 1, wherein said detents of each said first and second profiled members point in a first direction, while said detents of said third and fourth profiled members point in a second direction generally opposite to said first direction, said detent of said first profiled member being disposed between said third and fourth profiled members when the zipper is closed, and said fourth profiled member being disposed between said first and second profiled members when the zipper is closed.

4. The zipper as recited in claim 1, wherein said second base comprises a second plurality of apertures that form communication pathways from said zipper internal volume on another side of said second base.

5. The zipper as recited in claim 2, further comprising a post projecting from a portion of said second base located between said third and fourth profiled members, said post being disposed between said first and second profiled members when the zipper is closed.

6. A package comprising:

a structure made of web material defining a receptacle having an interior volume and a mouth at an upper end thereof; and a flexible zipper attached to said web material at said mouth and comprising first and second zipper parts, said first zipper part comprising a first base, and first and second generally hook-shaped profiled members projecting from one side of said first base and disposed generally parallel to each other with a first space therebetween, and said second zipper part comprising a second base, and third and fourth generally hook-shaped profiled members projecting from one side of said second base and disposed generally parallel to each other with a second space therebetween, each of said first through fourth generally hook-shaped profiled members having only one detent projecting from one side of its distal end, said first and second profiled members being respectively interlockable with said third and fourth profiled members to close said zipper, said interlocked profiled members and said first and second bases defining a zipper internal volume that extends along the length of said first and second profiled members, wherein said first base comprises a first plurality of apertures that form a first set of communication pathways from said zipper internal volume to said interior volume of said receptacle, the entirety of each aperture of said first plurality being disposed between said first and second generally hook-shaped profiled members.

7. The package as recited in claim 6, wherein said first plurality of apertures are arranged along a length of said first zipper part with respective spaces between successive apertures.

8. The package as recited in claim 6, wherein said detents of said first and second profiled members point away from each other, while said detents of said third and fourth profiled members point toward each other, said detents of said first and second profiled members being disposed between said third and fourth profiled members when the zipper is closed.

9. The package as recited in claim 6, wherein said detents of said first and second profiled members have hook-shaped profiles with respective detents that point in a first direction, while said detents of said third and fourth profiled members have hook-shaped profiles with respective detents that point in a second direction generally opposite to said first direction, said detent of said first profiled member being disposed between said third and fourth profiled members when the zipper is closed, and said fourth profiled member being disposed between said first and second profiled members when the zipper is closed.

10. The package as recited in claim 6, wherein said second base comprises a second plurality of apertures that form a second set of communication pathways from said zipper internal volume to said interior volume of said receptacle, the entirety of each aperture of said first plurality being disposed between said third and fourth generally hook-shaped profiled members.

11. The package as recited in claim 8, wherein said zipper further comprises a post projecting from a portion of said second base located between said third and fourth profiled members, said post being disposed between said first and second profiled members when the zipper is closed.

12. The package as recited in claim 6, wherein said first base comprises a first extension flange, while said second base comprises a second extension flange, said first and second base extension flanges being joined to said mouth of said receptacle.

13. A flexible zipper comprising a length of a first zipper strip and a substantially equal length of a second zipper strip, said first and second zipper strips being interlockable with each other along their length, said first zipper strip comprising a first base having a first plurality of apertures disposed entirely within a first zone thereof, and first and second projections disposed generally parallel to each other along said length, each aperture of said first plurality having a dimension along a line parallel to a lengthwise direction of said first zipper part that is less than the length of said first zipper part, and each of said first and second projections projecting along the entire length of said first zipper strip with a respective substantially constant profile and with only one detent projecting from one side of its distal end, said first projection projecting on one side of said first base from a second zone of said first base while said second projection projects on said one side of said first base from a third zone of said first base, said first zone of said first base being between said second and third zones of said first base; and said second zipper strip comprising a second base having a second plurality of apertures disposed entirely within a first zone of said second base, and third and fourth projections disposed generally parallel to each other along said length, each aperture of said second plurality having a dimension along a line parallel to a lengthwise direction of said second zipper part that is less than the length of said second zipper part, and each of said third and fourth projections projecting along the entire length of said second zipper strip with a respective substantially constant profile and with only one detent projecting from one side of its distal end, said third projection projecting on one side of said second base from a second zone of said second base while said fourth projection projects on said one side of said second base from a third zone of said second base, said first zone of said second base being between said second and third zones of said second base;

wherein said first and second projections are interlocked with said third and fourth projections when said zipper is closed, and are not interlocked with said third and fourth projections when said zipper is opened.

14. The zipper as recited in claim 13, wherein said detents of said first and second projections point away from each other, while said detents of said third and fourth projections point toward each other, said detents of said first and second projections being disposed between said third and fourth projections when the zipper is closed.

15. The zipper as recited in claim 13, wherein said detents of said first and second projections point in a first direction, while said detents of said third and fourth projections point in a second direction generally opposite to said first direction, said detent of said first projection being disposed between said third and fourth projections when the zipper is closed, and said fourth projection being disposed between said first and second projections when the zipper is closed.

16. The zipper as recited in claim 13, further comprising a post projecting from a portion of said second base located between said third and fourth projections, said post being disposed between said first and second projections when the zipper is closed.

17. A package comprising:

a receptacle having an interior volume and a mouth at an upper end thereof, said receptacle comprising front and rear walls, said mouth being formed by respective portions of said first and second walls; and a flexible zipper comprising a length of a first zipper strip and a substantially equal length of a second zipper strip, said first and second zipper strips being respectively attached to said respective portions of said first and second walls and being interlockable with each other along said length, said first zipper strip comprising a first base and first and second projections disposed in parallel along said length, said first base comprising a first plurality of apertures entirely disposed between said first and second projections and further comprising a first extension flange joined to said portion of said first wall; and said second zipper strip comprising a second base and third and fourth projections disposed in parallel along said length, said second base comprising a second plurality of apertures between said third and fourth projections and further comprising a second extension flange joined to said portion of said second wall, wherein said first through fourth projections are located within said interior volume of said receptacle, and said first and second pluralities of apertures allow a space between and bounded by said first and second zipper strips to communicate with said interior volume of said receptacle.

18. The package as recited in claim 17, wherein said detents of said first and second projections point away from each other, while said detents of said third and fourth projections point toward each other, said detents of said first and second projections being disposed between said third and fourth projections when the zipper is closed.

19. The package as recited in claim 17, wherein said detents of said first and second projections point in a first direction, while said detents of said third and fourth projections point in a second direction generally opposite to said first direction, said detent of said first profiled member being disposed between said third and fourth profiled members when the zipper is closed, and said fourth profiled member being disposed between said first and second profiled members when the zipper is closed.

20. The package as recited in claim 17, wherein said zipper further comprises a post projecting from a portion of said second base located between said third and fourth projections, said post being disposed between said first and second projections when the zipper is closed.

* * * * *